US006113433A

United States Patent [19]

Al-Turki

[11] Patent Number: 6,113,433

[45] Date of Patent: Sep. 5, 2000

[54] UNIVERSAL ELECTRIC LAMP SOCKET ADAPTER

[76] Inventor: Ali Al-Turki, Block 2, Str 24, House # 7, Al-Khaledyah, Kuwait

[21] Appl. No.: 09/084,299

[22] Filed: May 26, 1998

[51] Int. Cl.[7] ..... H01R 25/00

[52] U.S. Cl. ..... 439/639; 439/643; 439/644; 439/649; 362/228

[58] Field of Search ..... 439/642, 643, 439/644, 648, 649, 639, 641, 135, 136, 148, 144; 362/228, 249

[56] References Cited

U.S. PATENT DOCUMENTS

| | | | |
|---|---|---|---|
| 1,172,953 | 2/1916 | Dempster | 336/107 |
| 1,640,434 | 8/1927 | Weston | 439/644 |
| 3,335,389 | 8/1967 | Reichardt | 439/505 |
| 3,566,339 | 2/1971 | Cook | 439/643 |
| 4,408,813 | 10/1983 | Koehler | 439/148 |
| 4,936,789 | 6/1990 | Ugalde | 439/236 |
| 5,320,548 | 6/1994 | Schadhauser | 439/236 |
| 5,655,830 | 8/1997 | Ruskouski | 362/249 |

FOREIGN PATENT DOCUMENTS

| | | | |
|---|---|---|---|
| 2817122 | 10/1979 | Germany | 439/642 |

*Primary Examiner*—Brian Sircus
*Assistant Examiner*—Michael C. Zarroli
*Attorney, Agent, or Firm*—Michael I. Kroll

[57] ABSTRACT

An universal electrical lamp socket adapter for connecting multiple light bulbs to a single electrical socket. The universal electrical lamp socket adapter includes a central section and an adapter extending from an underside of the adapter for mating with the electrical socket. A first device for receiving an Edison type light bulb therein is positioned on the central section and a second device for receiving a Bayonet type light bulb therein is also positioned on the central section. The adapter and both the first and second receiving devices are electrically connected through the central section. When the adapter is coupled to a socket and at least one of an Edison type bulb is received within the first receiving device and a bayonet type light bulb is received within the second receiving device, power is provided to the at least one of the Edison type bulb and the Bayonet type light bulb allowing the at least one of the Edison type bulb and the Bayonet type light bulb to illuminate. The adapter is able to connect to either an Edison or Bayonet type socket and the first and second receiving devices are able to receive either standard size or candelabra size light bulbs.

3 Claims, 10 Drawing Sheets

UNIVERSAL ELECTRIC LAMP SOCKET ADAPTER

BACKGROUND OF THE INVENTION

1. Field of the Invention

The present invention relates generally to electrical lamp lighting fixture bulb adapters and, more specifically, to an adapter for providing multiple socket outlets from a single electrical socket thereby allowing the use of any combination of Edison and Bayonet type light bulbs with the single electrical socket.

2. Description of the Prior Art

Numerous light bulb socket adapters which allow for the installation of a single light bulb for use with a single electrical fixture socket are provided in the prior art. While these light bulb adapters may be suitable for the particular purpose to which they address, they would not be as suitable for the purposes of the present invention as heretofore described. It is thus desirable to provide a light bulb adapter able to provide an option between using an Edison type lightbulb, Bayonet type lightbulb or both in a single electrical socket. It is further desirable to provide a light bulb adapter having multiple outlets thereby eliminating the need for using any single type of lightbulb with a fixture. By Edison type light bulb is meant herein a light bulb which threads into a threaded socket.

SUMMARY OF THE PRESENT INVENTION

The present invention relates generally to electrical lamp lighting fixture bulb adapters and, more specifically, to an adapter for providing multiple socket outlets from a single electrical socket thereby allowing the use of any combination of Edison and Bayonet type light bulbs with the single electrical socket.

A primary object of the present invention is to provide an universal electrical lamp socket adapter that will overcome the shortcomings of prior art devices.

Another object of the present invention is to provide an universal electrical lamp socket adapter which allows use of any combination of Edison type light bulbs, Bayonet type light bulbs or both in a single outlet.

A further object of the present invention is to provide an universal electrical lamp socket adapter able to form an electrically conductive connection for multiple electrical sockets with a single electrical socket.

An additional object of the present invention is to provide an universal electrical lamp socket adapter including multiple electrical sockets electrically connected with the single socket.

A still further object of the present invention is to provide an universal electrical lamp socket adapter including a cover device providing a removable seal over any of the multiple outlets not in use to thereby protect persons in the surrounding area from possible contact with an exposed, live electrical socket.

A yet further object of the present invention is to provide an universal electrical lamp socket adapter having a substantially nonconductive outer surface for protecting the user from defective sockets and inadvertant contact with electrically conductive components of the socket and/or adapter.

An even further object of the present invention is to provide an universal electrical lamp socket adapter able to provide multiple sockets receiving lower power light bulbs than that which the socket in which the adapter is placed is able to accomodate.

A still further object of the present invention is to provide an universal electrical lamp socket adapter allowing installation of Edison and Bayonet candelabra type light bulbs into a socket having a standard Edison type base.

An even further object of the present invention is to provide an universal electrical lamp socket adapter allowing installation of Edison and Bayonet candelabra type light bulbs into a socket having a standard Bayonet type socket.

Another object of the present invention is to provide an universal electrical lamp socket adapter that is simple and easy to use.

A still further object of the present invention is to provide an universal electrical lamp socket adapter that is economical in cost to manufacture.

Additional objects of the present invention will appear as the description proceeds.

An universal electrical lamp socket adapter for connecting multiple light bulbs to a single electrical socket is described by the present invention. The universal electrical lamp socket adapter includes a central section and an adapter extending from an underside of the adapter for mating with the electrical socket. A first device for receiving an Edison type light bulb therein is positioned on the central section and a second device for receiving a Bayonet type light bulb therein is also positioned on the central section. The adapter and both the first and second receiving devices are electrically connected through the central section. When the adapter is coupled to a socket and at least one of an Edison type bulb is received within the first receiving device and a bayonet type light bulb is received within the second receiving device, power is provided to the at least one of the Edison type bulb and the Bayonet type light bulb allowing the at least one of the Edison type bulb and the Bayonet type light bulb to illuminate. The adapter is able to connect to either an Edison or Bayonet type socket and the first and second receiving devices are able to receive either standard size or candelabra size light bulbs.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

Figure 9:
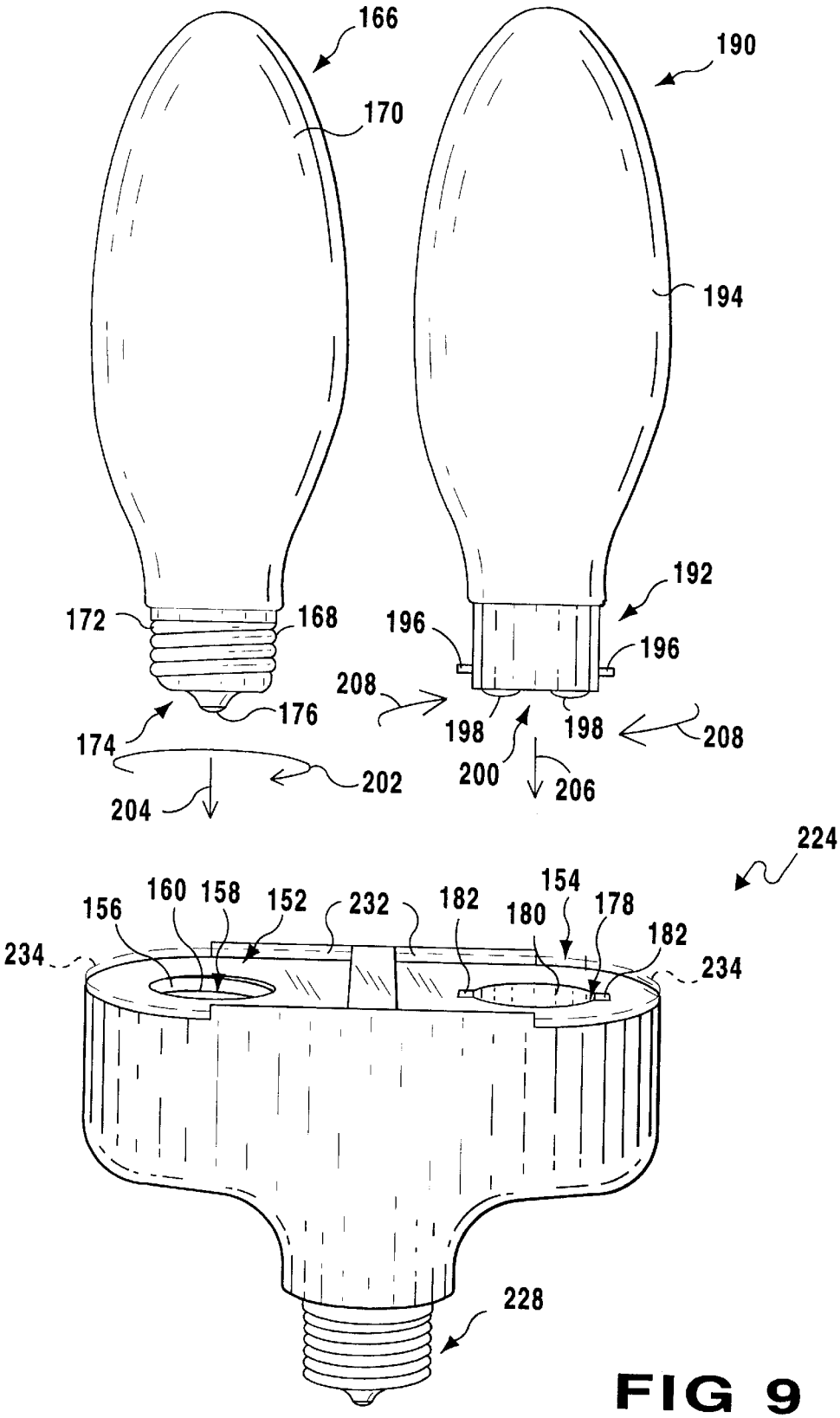
Figure 10:
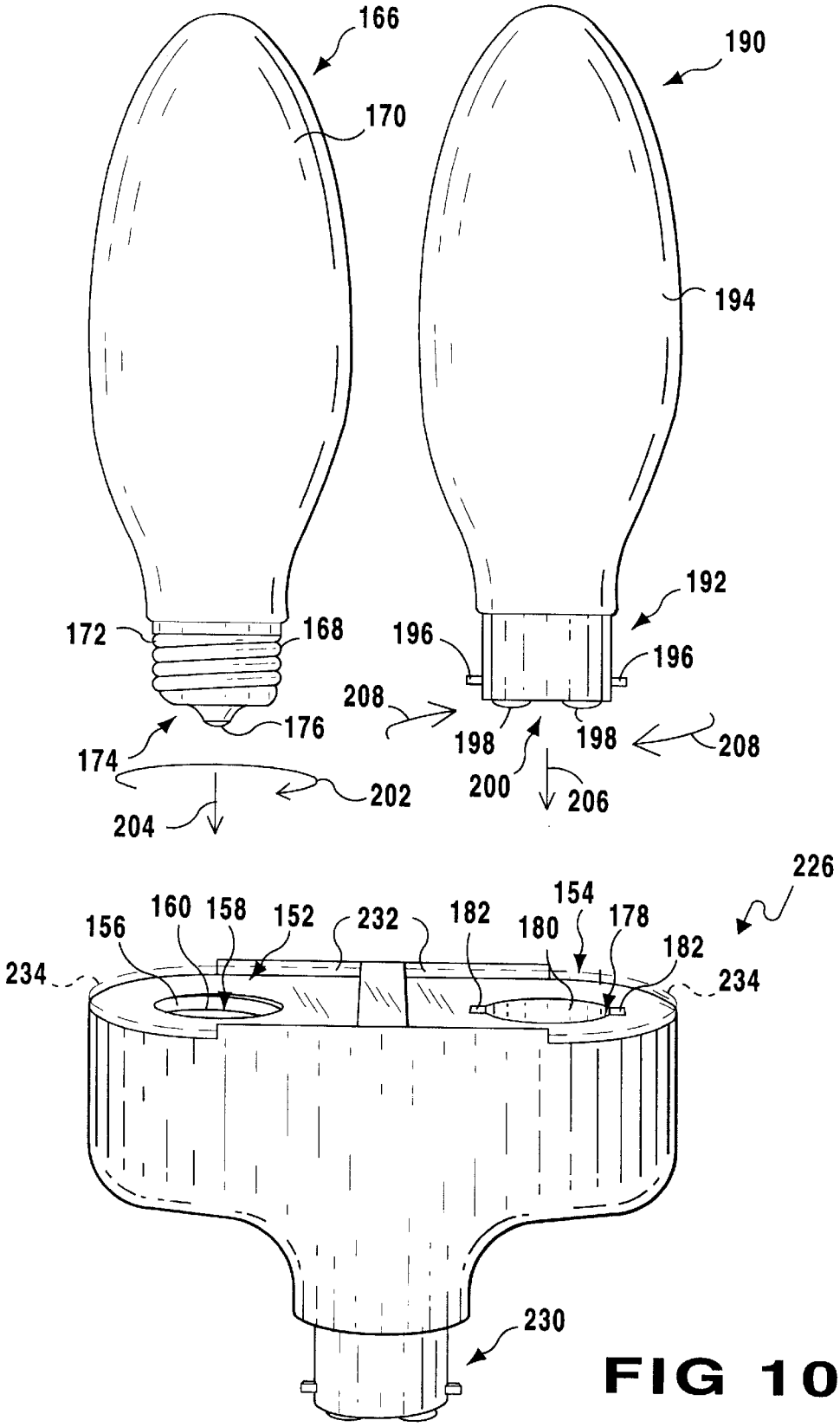

FIG. 9 is a perspective view of a fifth embodiment of the universal electrical lamp socket adapter of the present invention for connection with a candelabra Edison type electrical socket, the adapter being able to accomodate both a Edison and Bayonet candelabra type light bulbs; and FIG. 10 is a perspective view of a fourth embodiment of the universal electrical lamp socket adapter of the present invention for connection with a candelabra Bayonet type electrical socket, the adapter being able to accomodate both a Edison and Bayonet candelabra type light bulbs.

DESCRIPTION OF THE REFERENCED NUMERALS

Turning now descriptively to the drawings, in which similar reference characters denote similar elements throughout the several views, the Figures illustrate the universal electrical lamp socket adapter of the present invention. With regard to the reference numerals used, the following numbering is used throughout the various drawing figures.

10 first embodiment of universal electrical lamp socket adapter
12 standard Edison type socket
14 bulb receiving section of Edison type socket
16 bulb receiving pool of Edison type socket
18 thread spiraling within bulb receiving pool of Edison type socket
20 central section of first embodiment
22 underside of central section
24 Edison type adapter
26 Thread spiraling around Edison type adapter
28 base side of Edison type adapter
30 contact terminal n base of Edison type adapter
32 Edison type socket
34 Bayonet type socket
36 inner side of Edison type socket
38 bulb receiving pool in Edison type socket
40 thread spiraling around inner side of Edison socket
42 conventional light bulb for use in Edison type socket
44 base side of Edison type light bulb
46 bulb section of Edison type light bulb
48 thread spiraling around base portion of Edison type light bulb
50 base side of Edison type bulb
52 contact terminal on base side of Edison type bulb
54 bulb receiving pool of Bayonet type socket
56 inner side of Bayonet type socket
58 pair of L-shaped recesses
60 Bayonet type light bulb
62 base portion of bayonet type light bulb
64 bulb portion of bayonet type light bulb
66 pins extending from base of bayonet type light bulb
68 contact terminals on bayonet type light bulb
70 underside of bayonet type light bulb
72 arrow indicating direction for turning Edison type bulb for connection with Edison type socket
74 arrow indicating direction of force applied to Edison type bulb for connection with Edison type socket
76 arrow indicating direction to turn Bayonet type light bulb for connection with Bayonet type socket
78 arrow indicating direction of force applied to Bayonet type light bulb for connection with Bayonet type socket
80 first contact terminal within Bayonet type socket
82 second contact terminal within Bayonet type socket
84 first coupling wire
86 base side of Edison type socket
88 contact terminal within Edison type socket
90 second coupling wire
100 second embodiment of universal electrical lamp socket adapter
102 central section of first embodiment
104 underside of central section
106 Bayonet type adapter
108 base portion of Bayonet type adapter
110 pair of pins on Bayonet type adapter
112 first contact terminal of Bayonet type adapter
114 second contact terminal of Bayonet type adapter
116 underside of Bayonet type adapter
118 Edison type socket
120 Bayonet type socket
122 inner side of Edison type socket
124 bulb receiving pool in Edison type socket
126 thread spiraling around inner side of Edison socket
128 contact terminal within Edison type socket
130 bulb receiving pool of Bayonet type socket
132 inner side of Bayonet type socket
134 pair of L-shaped recesses
136 first contact terminal within Bayonet type socket
138 second contact terminal within Bayonet type socket
140 first coupling wire
142 base side of Edison type socket
144 second coupling wire
146 third embodiment of universal electrical lamp socket adapter
148 central section of third embodiment
150 underside of central section
152 candelabra Edison type socket
154 candelabra Bayonet type socket
156 inner side of candelabra Edison type socket
158 bulb receiving pool in candelabra Edison type socket

160 thread spiraling around inner side of candelabra Edison socket

162 base of bulb receiving pool in candelabra Edison type socket

164 contact terminal in bulb receiving pool in candelabra Edison type socket

166 conventional light bulb for use in candelabra Edison type socket

168 base side of candelabra Edison type light bulb

170 bulb section of candelabra Edison type light bulb

172 thread spiraling around base portion of candelabra Edison type light bulb

174 base side of candelabra Edison type bulb

176 contact terminal on base side of candelabra Edison type bulb

178 bulb receiving pool of candelabra Bayonet type socket

180 inner side of candelabra Bayonet type socket

182 pair of L-shaped recesses

184 base of bulb receiving pool of candelabra Bayonet type socket

186 first contact terminal within candelabra Bayonet type socket

188 second contact terminal within candelabra Bayonet type socket

190 candelabra Bayonet type light bulb

192 base portion of candelabra Bayonet type light bulb

194 bulb portion of candelabra Bayonet type light bulb

196 pins extending from base of candelabra Bayonet type light bulb

198 contact terminals on candelabra Bayonet type light bulb

200 underside of candelabra Bayonet type light bulb

202 arrow indicating direction for turning candelabra Edison type bulb for connection with candelabra Edison type socket

204 arrow indicating direction of force applied to candelabra Edison type bulb for connection with candelabra Edison type socket

206 arrow indicating direction to turn candelabra Bayonet type light bulb for connection with candelabra Bayonet type socket

208 arrow indicating direction of force applied to candelabra Bayonet type light bulb for connection with candelabra Bayonet type socket

210 first coupling wire

212 second coupling wire

214 third embodiment of universal electrical lamp socket adapter

216 central section of first embodiment

218 underside of central section

220 first coupling wire of fourth embodiment

222 second connecting wire of fourth embodiment

224 fifth embodiment of the universal electrical lamp socket adapter

226 sixth embodiment of the universal electrical lamp socket adapter

228 candelabra size Edison type adapter of the fifth embodiment

230 candelabra size Bayonet type adapter of the sixth embodiment

232 retaining device

234 protective cover

DETAILED DESCRIPTION OF THE PREFERRED EMBODIMENT

Figure 1:
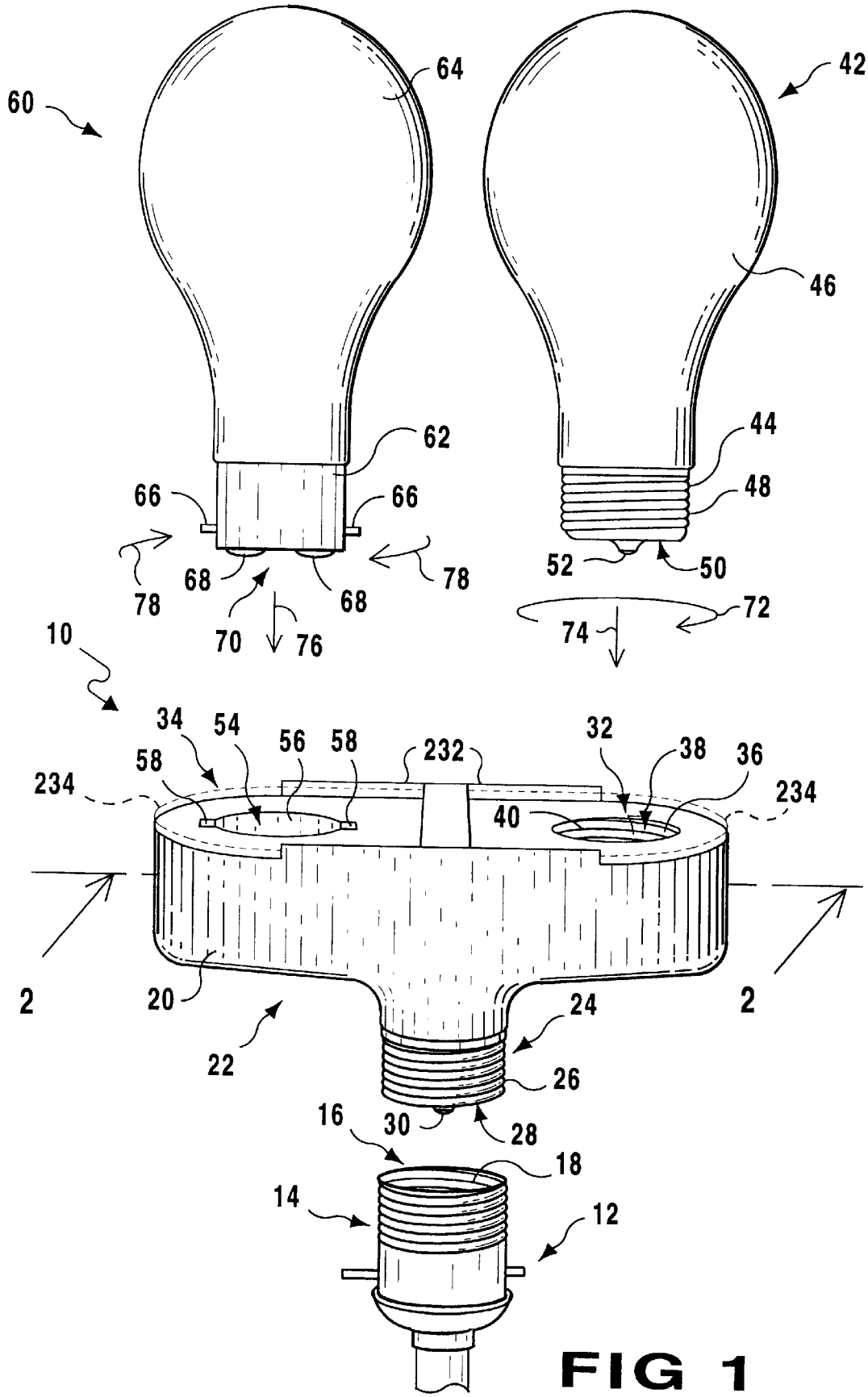
FIG. 1 is a perspective view of a first embodiment of the universal electrical lamp socket adapter of the present invention for connection with a standard Edison type electrical socket, the adapter being able to accomodate both a standard Edison and standard Bayonet type light bulbs.
Figure 2:
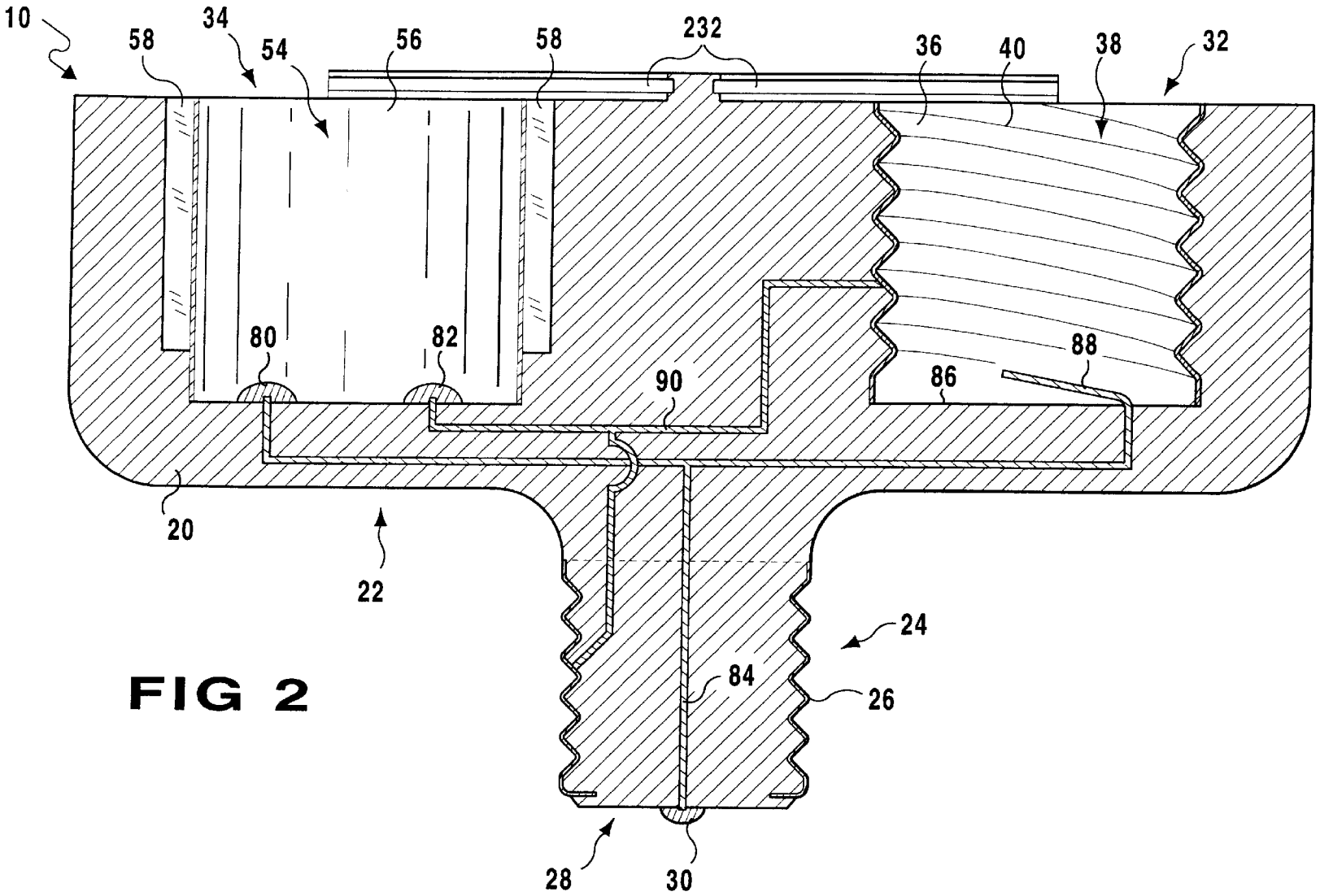
FIG. 2 is a cross-sectional of the an universal electrical lamp socket adapter of the present invention taken along the line 2-2 of FIG. 1.

Turning now descriptively to the drawings, in which similar reference characters denote similar elements throughout the several views, FIGS. 1 and 2 illustrate a first embodiment of the universal electrical lamp socket adapter of the present invention indicated generally by the numeral 10. The first embodiment of the universal electrical lamp socket adapter 10 is for connection with a standard Edison type socket 12 illustrated in FIG. 1. The Edison type socket 12 includes a bulb receiving section 14 forming a bulb receiving pool 16 and a thread 18 spiraling around an inner side of the bulb receiving pool 16. The thread 18 is for mating with a thread spiraling around a conventional Edison type light bulb for establishing an electrical connection with the light bulb.

The universal electrical lamp socket adapter 10 includes a central section 20. Extending from an underside 22 of the central section 20 is an Edison type adapter 24. The Edison type adapter 24 is sized to be received by a standard Edison type socket 12 and includes a thread 26 spiraling therearound. On an underside 28 of the Edison type adapter 24 is an electrical contact terminal 30. When the universal electrical lamp socket adapter 10 is received by the Edison type socket 12, the thread 26 spiraling around the base section 24 mates with the thread 18 spiraling within the bulb receiving pool 16 releasably holding the universal electrical lamp socket adapter 10 therein. In this position, the electrical contact terminal 30 is in contact with a contact terminal within the bulb receiving pool 16.

On a top side of the central section 20 is a standard Edison type socket 32 and a standard size Bayonet type socket 34. The standard size Edison type socket 32 includes an inner side 36 defining a bulb receiving pool 38 and a thread 40 spiraling therearound. On a bottom side of the bulb receiving pool 38 is a contact terminal 88 as shown in FIG. 2. The bulb receiving pool 38 is of a size able to receive a standard Edison type light bulb 42.

A conventional Edison type lightbulb 42 includes a base portion 44 extending from a bulb portion 46 thereof. The base portion 44 includes a thread 48 spiraling therearound. The base portion 44 is formed from a conductive material. On an underside 50 of the base section 44 is an electrical contact terminal 52. The electrical contact terminal 52 is electrically isolated from the base portion 44.

The standard size Bayonet type socket 36 is defined by a bulb receiving pool 54 defined by an inner side 56. Extending along a length of the inner side 56 are a pair of L-shaped recesses 58. The bulb receiving pool 38 is of a size able to receive a standard Bayonet type light bulb 60. Positioned on a bottom side of the bulb receiving pool 54 are a pair of contact terminals as shown in FIG. 2.

A conventional Bayonet type light bulb 60 includes a base portion 62 extending from a bulb portion 64 thereof. The base portion 62 includes a pair of pins 66 extending therefrom and a pair of contact terminals 68 extending from an underside 70 thereof.

The universal electrical lamp socket adapter 10 is connected to a conventional standard size Edison type socket by positioning the Edison type adapter 24 at an entrance to the bulb receiving pool 16 of the Edison type socket 12 and turning the universal electrical lamp socket adapter 10 in a clockwise direction while applying a force towards the bulb receiving pool 16. The universal electrical lamp socket adapter 10 is turned until it is completely received within the bulb receiving pool 16 so that the contact terminal 30 is in contact with an electrical contact on a base of the bulb receiving pool 16. The Edison type socket is formed of a conductive material which forms an electrical connection with the bulb receiving pool 16 as shown in FIG. 2.

The Edison type light bulb 42 must be turned in a clockwise direction as indicated by the arrow labeled 72 while applying a force towards the thread 40 spiraling within the inner side 36 of the Edison type socket 32 as indicated by the arrow labeled 74 to insert the Edison type light bulb 42 into the Edison type socket 32. This will cause the thread 48 on the base 44 of the Edison type bulb 42 to mate with the thread 40 on the inner side 36 of the Edison type socket 32 and thereby be received and held within the Edison type socket 32.

In order to connect the bayonet type light bulb 60 to the Bayonet type socket 34 of the universal electrical lamp socket adapter 10 a force is applied to the bayonet type light bulb 60 in the direction of the arrows labeled 76. This causes the base portion 62 of the bayonet type light bulb 60 to be completely inserted into the bulb receiving pool 54 whereby the pair of pins 66 are received by their respective L-shaped recess 58. The bayonet type light bulb 60 is then turned in a counterclockwise direction as illustrated by the arrows labeled 78 causing the pair of pins 66 to be seated in a horizontal portion of their respective L-shaped recess 58 and the pair of contact terminals 68 on the underside 70 of the base portion 62 of the bayonet type light bulb 60 to form an electrical contact with a pair of contacts within the bulb receiving pool 54 to complete the circuit as will be discussed hereinafter with specific reference to FIG. 2.

FIG. 2 illustrates a cross-section of the universal electrical lamp socket adapter 10 shown in FIG. 1. As can be seen from this figure, the Edison type adapter 24 is formed from an electrically conductive material for forming a conductive connection with the bulb receiving pool 16 of a conventional Edison type socket 12. The electrically conductive material is electrically isolated from the contact terminal 30. The inner side 36 of the bulb receiving pool 38 is also made of an electrically conductive material for forming a conductive connection with the base portion 44 of a conventional Edison type light bulb 42. At the base of the Bayonet type socket 34 are first and second contact terminals 80 and 82, respectively. A first electrically conductive coupling wire 84 is connected between the contact terminal 30 on the base of the Edison type adapter 24 and the first contact terminal 80 within the bulb receiving pool 54. The first coupling wire 84 also extends through a base side 86 of the Edison type socket 32 forming a contact terminal 88 for connection to an Edison type light bulb 42 received therein. The contact terminal 88 formed within the Edison type socket 32 is electrically isolated from the electrically conductive inner wall 36. A second connection wire 90 is connected between the electrically conductive material forming the Edison type adapter 24 and both the electrically conductive inner wall 36 and the second terminal 82 within the bulb receiving pool 54. The first and second coupling wires 84 and 88, respectively, provide an electrical connection with both the Edison and Bayonet type sockets 32 and 34, respectively, for providing power to illuminate light bulbs received thereby.

Figure 3:
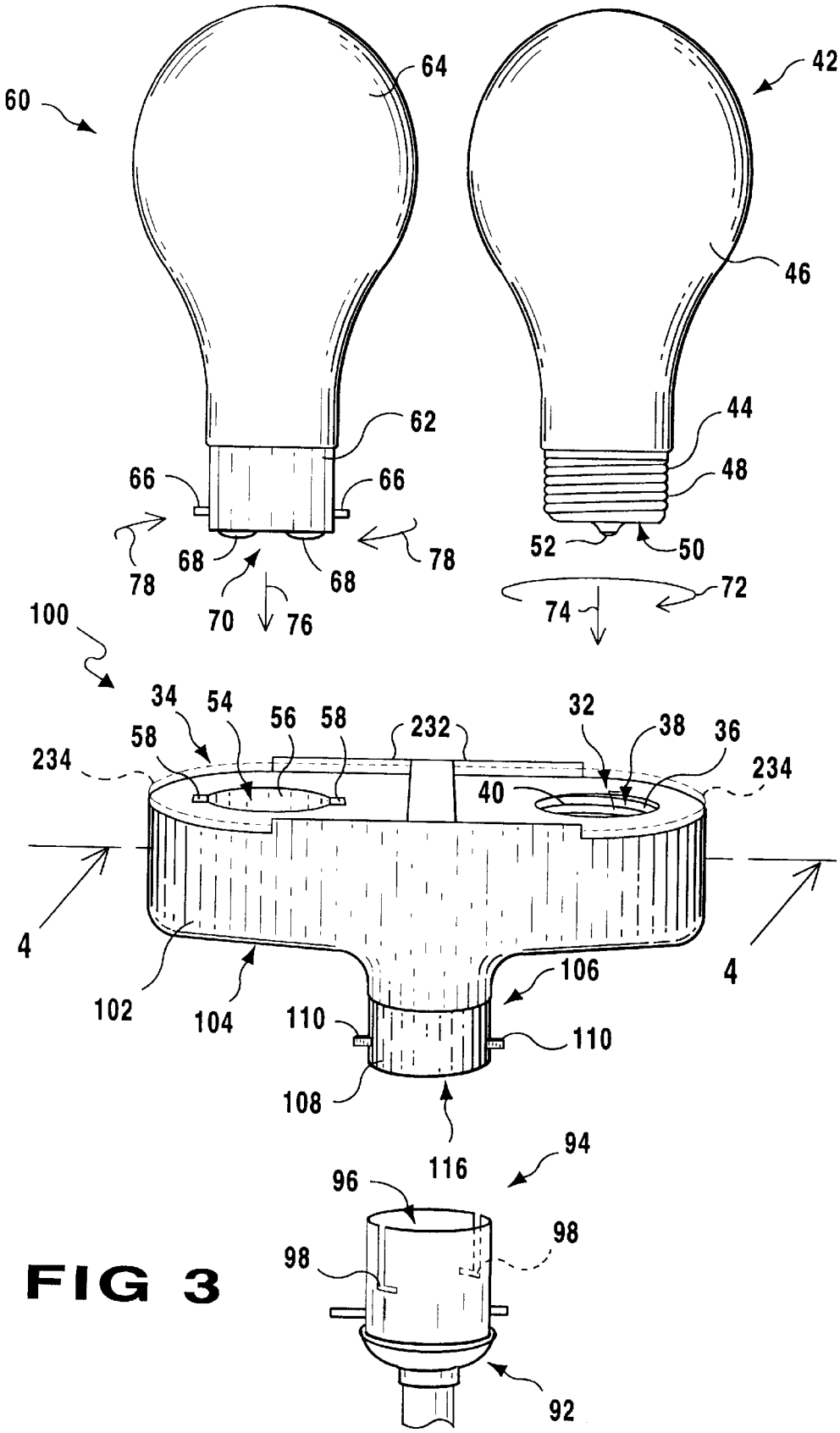
FIG. 3 is a perspective view of a second embodiment of the universal electrical lamp socket adapter of the present invention for connection with a standard Bayonet type electrical socket, the adapter being able to accomodate both a standard Edison and standard Bayonet type light bulbs.
Figure 4:
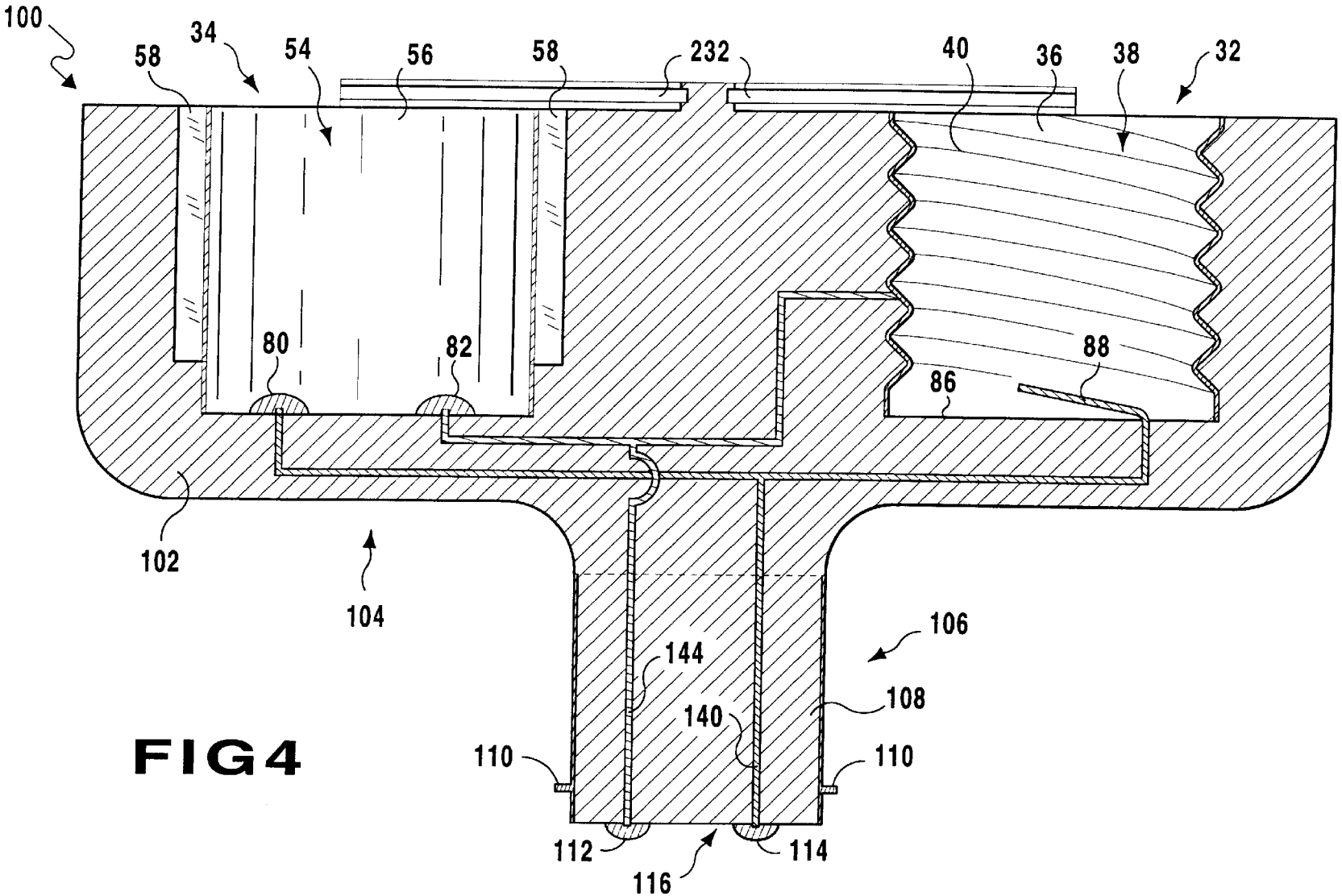
FIG. 4 is a cross-sectional of the an universal electrical lamp socket adapter of the present invention taken along the line 4—4 of FIG. 3.

FIGS. 3 and 4 illustrate a second embodiment of the universal electrical lamp socket adapter 100 for connection with a Bayonet type socket 92. The Bayonet type socket 92 includes a base section 94 including a bulb receiving pool 96. A pair of pin receiving L-shaped recesses 98 extend from opposing sides of the base section 92.

The second embodiment of the universal electrical lamp socket adapter 100 of the present invention includes a central section 102. Extending from an underside 104 of the central section 102 is a Bayonet type adapter 106. The Bayonet type adapter 106 is sized to be received by a standard Bayonet type socket 92 and includes a base portion 108 including a pair of pins 110 extending from a side thereof and a pair of contact terminals 112 and 114 extending from an underside 116 thereof. The first and second electrical contact terminals 112 and 114 can be seen in FIG. 4. When the universal electrical lamp socket adapter 100 is received by the Bayonet type socket 92, the pair of pins 110 are received by the pair of L-shaped recesses 98 releasably holding the universal electrical lamp socket adapter 100 therein. In this position, the first and second electrical contact terminals 112 and 114 are in contact with first and second contact terminals within the bulb receiving pool 96.

On a top side of the central section 102 is a standard Edison type socket 32 and a standard size Bayonet type socket 34 identically to that described with respect to FIGS. 1 and 2. Identical reference numbers are used to illustrate similar elements throughout the several embodiments of the present invention.

The standard size Edison type socket 32 includes an inner side 34 defining a bulb receiving pool 36 having a thread 38 spiraling therearound. On a bottom side of the bulb receiving pool 36 is a contact terminal 88 as is illustrated in FIG. 4. The bulb receiving pool 36 is of a size able to receive a standard Edison type light bulb 42.

The standard size Bayonet type socket 34 is defined by a bulb receiving pool 54 having an inner side 56. Extending along a length of the inner side 56 are a pair of L-shaped recesses 58. The bulb receiving pool 54 is of a size able to receive a standard Bayonet type light bulb 60. Positioned on a bottom side of the bulb receiving pool 54 are a pair of contact terminals 80 and 82, respectively, as illustrated in FIG. 4.

The universal electrical lamp socket adapter 100 is connected to a conventional standard size Bayonet type socket by positioning the Bayonet type adapter 106 at an entrance to the bulb receiving pool 96 of the Bayonet type socket 92 and applying a force to the universal electrical lamp socket adapter 100 and towards the Bayonet type socket 92. This causes the base portion 108 of the universal electrical lamp socket adapter 100 to be completely inserted into the bulb receiving pool 96 whereby the pair of pins 110 are received by their respective L-shaped recess 98. The universal electrical lamp socket adapter 100 is then turned in a counterclockwise direction causing the pair of pins 110 to be seated in a horizontal portion of their respective L-shaped recess 98 and the first and second contact terminals 112 and 114, respectively, on the underside 116 of the base portion 108 of the universal electrical lamp socket adapter 100 to form an electrical contact with a pair of contacts within the bulb receiving pool 96.

Insertion of an Edison type light bulb 42 into the Edison type socket 32 and insertion of the Bayonet type light bulb 60 into the Bayonet type socket 34 are performed in the same manner as described above with respect to FIGS. 1 and 2 and thus are not described further with respect to the second embodiment of the universal electrical lamp socket adapter 100 illustrated in FIGS. 3 and 4.

FIG. 4 illustrates a cross-section of the universal electrical lamp socket adapter 100 shown in FIG. 3. As can be seen from this figure, the Bayonet type adapter 106 includes the first and second contact terminals 112 and 114, respectively on the underside 116 thereof. A first electrically conductive coupling wire 140 is connected between the first contact terminal 112 on the underside of the Bayonet type adapter 106 and the first contact terminal 80 within the bulb receiving pool 54. The first coupling wire 140 also extends through a base side 86 of the Edison type socket 32 forming the contact terminal 88 for connection to an Edison type light bulb 42 received therein. The contact terminal 88 formed within the Edison type socket 32 is electrically isolated from the electrically conductive inner wall 36. A second connection wire 144 is connected between the second contact terminal 114 on the underside of the Bayonet type adapter 106 and both the electrically conductive inner wall 36 and the second terminal 82 within the bulb receiving pool 54. The first and second coupling wires 140 and 144, respectively, provide an electrical connection with both the Edison and Bayonet type sockets 32 and 34, respectively, for providing power to light bulbs received thereby.

Figure 5:
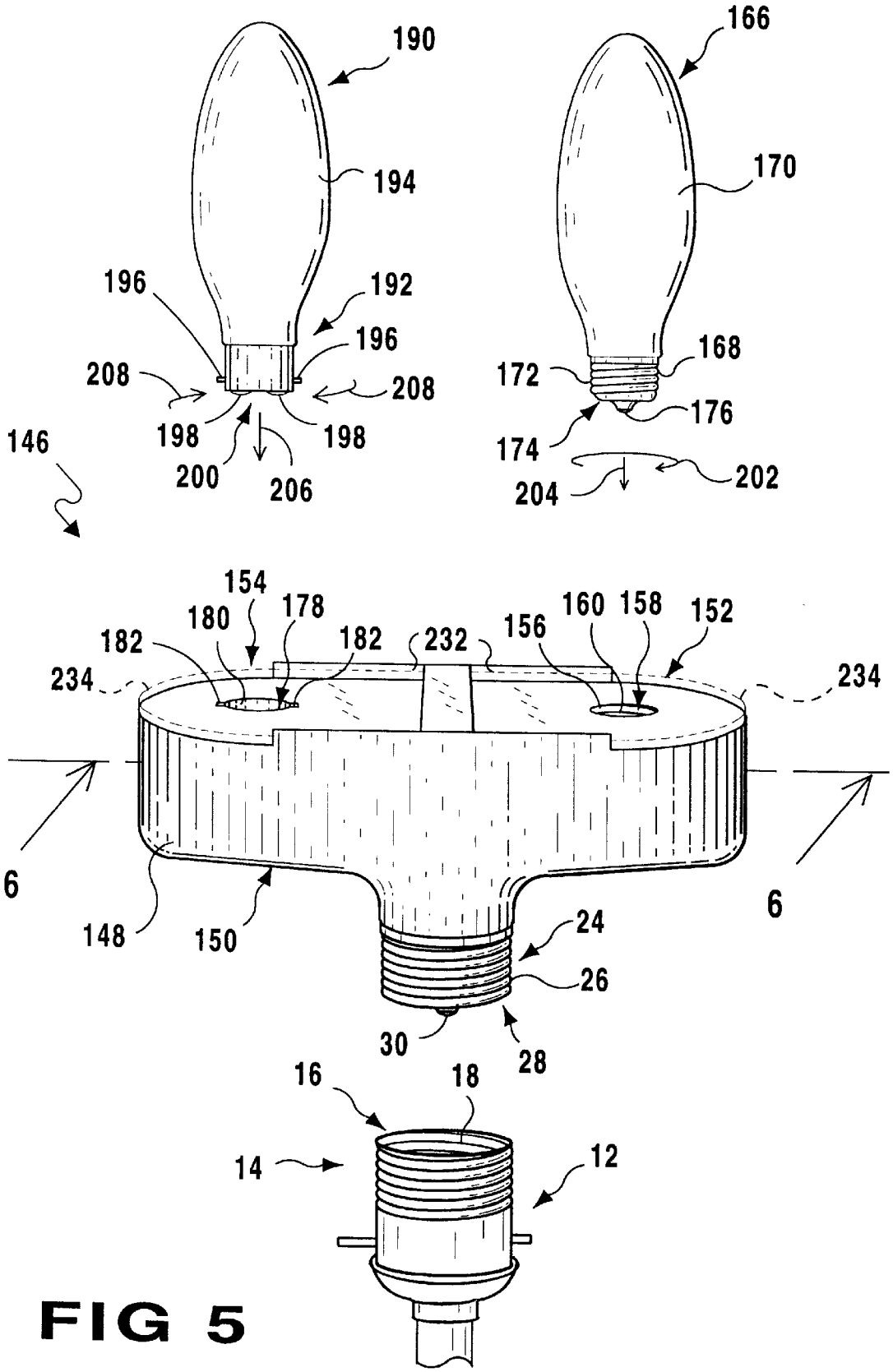
FIG. 5 is a perspective view of a third embodiment of the universal electrical lamp socket adapter of the present invention for connection with a standard Edison type electrical socket, the adapter being able to accomodate both a Edison and Bayonet candelabra type light bulbs.
Figure 6:
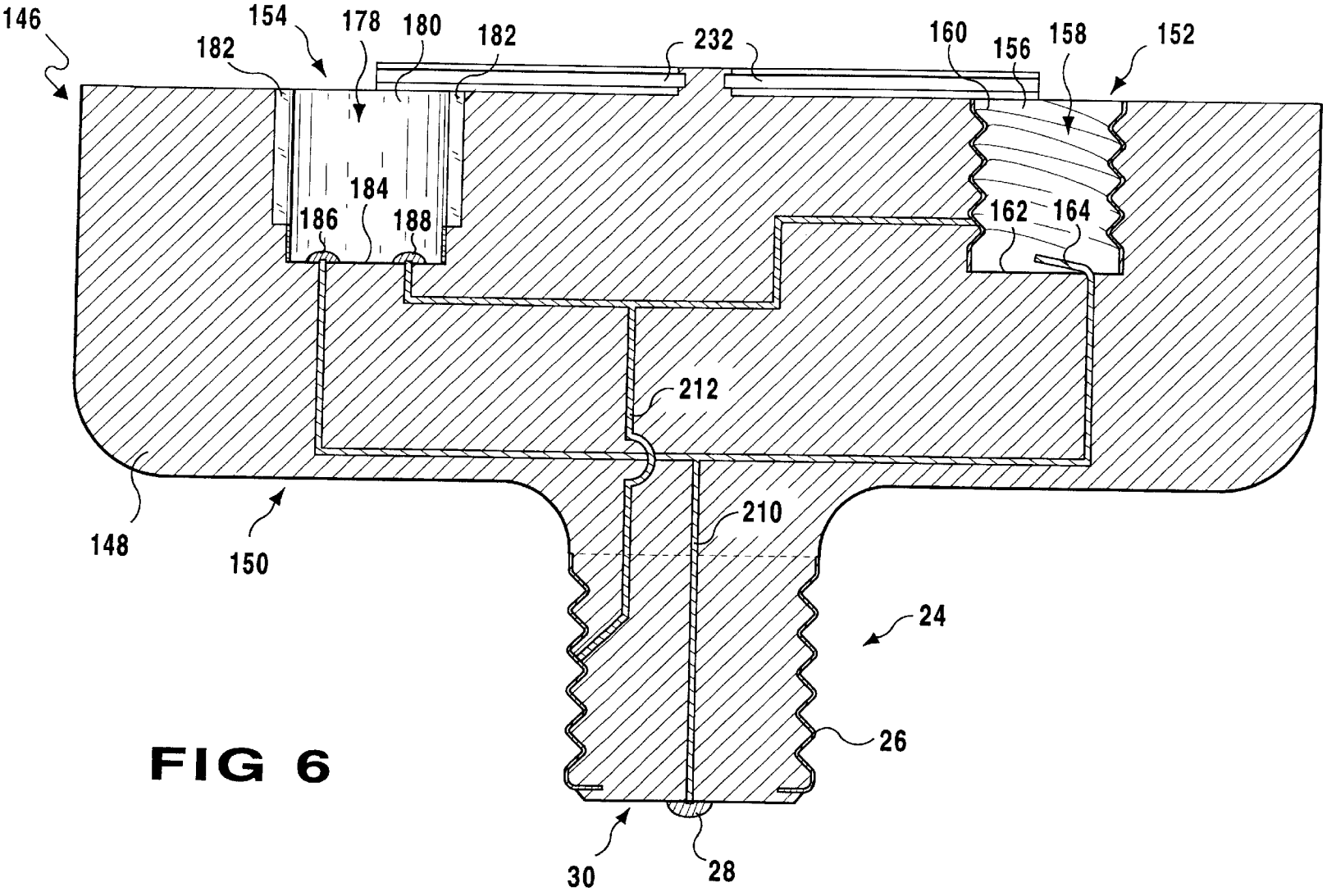
FIG. 6 is a cross-sectional of the universal electrical lamp socket adapter of the present invention taken along the line 6—6 of FIG. 5.

FIGS. 5 and 6 illustrate a third embodiment of the universal electrical lamp socket adapter of the present invention indicated generally by the numeral 146. The third embodiment of the universal electrical lamp socket adapter 146 is for connecting a candelabra sized Edison and Bayonet type light bulb with a standard Edison type socket 12 illustrated in FIG. 5.

The universal electrical lamp socket adapter 146 includes a central section 148. Extending from an underside 150 of the central section 148 is an Edison type adapter 24. The Edison type adapter is identical to the Edison type adapter described with reference to FIGS. 1 and 2 and thus further discussion of such is not necessary.

On a top side of the central section 20 is a candelabra size Edison type socket 152 and a candelabra size Bayonet type socket 154. The candelabra size Edison type socket 152 includes an inner side 156 defining a bulb receiving pool 158 and a thread 160 spiraling therearound. On a bottom side 162 of the bulb receiving pool 158 is a contact terminal 164 as shown in FIG. 6. The bulb receiving pool 158 is of a size able to receive a candelabra Edison type light bulb.

A conventional candelabra Edison type light bulb 166 includes a base portion 168 extending from a bulb portion 170 thereof. The base portion 168 includes a thread 172 spiraling therearound. The base portion 168 is formed from a conductive material. On an underside 174 of the base portion 168 is an electrical contact terminal 176. The electrical contact terminal 174 is electrically isolated from the base portion 168.

The candelabra size Bayonet type socket 154 is defined by a bulb receiving pool 178 having an inner side 180. Extending along a length of the inner side 180 are a pair of L-shaped recesses 182. The bulb receiving pool 178 is of a size able to receive a candelabra Bayonet type light bulb 190. Positioned on a base side 184 of the bulb receiving pool 178 are first and second contact terminals 186 and 188, respectively, as shown in FIG. 6.

A conventional candelabra Bayonet type light bulb 190 includes a base portion 192 extending from a bulb portion 194 thereof. The base portion 192 includes a pair of pins 196 extending therefrom and a pair of contact terminals 198 extending from an underside 200 thereof.

The universal electrical lamp socket adapter 146 is connected to a conventional standard size Edison type socket by positioning the Edison type adapter 24 at an entrance to the bulb receiving pool 16 of the Edison type socket 12 and turning the universal electrical lamp socket adapter 10 in a clockwise direction while applying a force towards the bulb receiving pool 16. The universal electrical lamp socket adapter 10 is turned until it is completely received within the bulb receiving pool 16 so that the contact terminal 30 is in contact with an electrical contact on a base of the bulb receiving pool 16. The Edison type socket is formed of a conductive material which forms an electrical connection with the bulb receiving pool 16 as shown in FIG. 6.

The candelabra Edison type light bulb 166 must be turned in a clockwise direction as indicated by the arrow labeled 202 while applying a force towards the thread 160 spiraling within the inner side 156 of the Edison type socket 152 as indicated by the arrow labeled 204 to insert the candelabra Edison type light bulb 166 into the Edison type socket 152. This will cause the thread 172 on the base 168 of the candelabra Edison type bulb 166 to mate with the thread 160 on the inner side 156 of the candelabra Edison type socket 152 and thereby be received and held within the candelabra Edison type socket 152.

In order to connect the candelabra bayonet type light bulb 190 to the candelabra Bayonet type socket 154 of the universal electrical lamp socket adapter 146 a force is applied to the bayonet type light bulb 190 in the direction of the arrows labeled 206. This causes the base portion 192 of the candelabra Bayonet type light bulb 190 to be completely inserted into the bulb receiving pool 178 whereby the pair of pins 196 are received by their respective L-shaped recess 182. The candelabra Bayonet type light bulb 190 is then turned in a counterclockwise direction as illustrated by the arrows labeled 208 causing the pair of pins 196 to be seated in a horizontal portion of their respective L-shaped recess 182 and the pair of contact terminals 198 on the underside 200 of the base portion 192 of the candelabra Bayonet type light bulb 190 to form an electrical contact with a pair of contacts within the bulb receiving pool 178 to complete the circuit as shown in FIG. 6.

FIG. 6 illustrates a cross-section of the universal electrical lamp socket adapter 146 shown in FIG. 5. As can be seen from this figure, the Edison type adapter 24 is formed from an electrically conductive material for forming a conductive connection with the bulb receiving pool 16 of a conventional Edison type socket 12. The electrically conductive material is electrically isolated from the contact terminal 30. The inner side 156 of the bulb receiving pool 158 is also made of an electrically conductive material for forming a conductive connection with the base portion 168 of a conventional candelabra Edison type light bulb 42. At the base of the Bayonet type socket 34 are first and second contact terminals 186 and 188, respectively. A first electrically conductive coupling wire 210 is connected between the contact terminal 30 on the base of the Edison type adapter 24 and the first contact terminal 186 within the bulb receiving pool 178. The first coupling wire 210 also extends through a base side 162 of the candelabra Edison type socket 152 forming a contact terminal 164 for connection to a candelabra Edison type light bulb 166 received therein. The contact terminal 164 formed within the Edison type socket 152 is electrically isolated from the electrically conductive inner wall 156. A second connection wire 212 is connected between the electrically conductive material forming the Edison type adapter 24 and both the electrically conductive inner wall 156 and the second terminal 188 within the bulb receiving pool 178. The first and second coupling wires 210 and 212, respectively, provide an electrical connection with both the Edison and Bayonet type sockets 152 and 154, respectively, for providing power to light bulbs received thereby.

Figure 7:
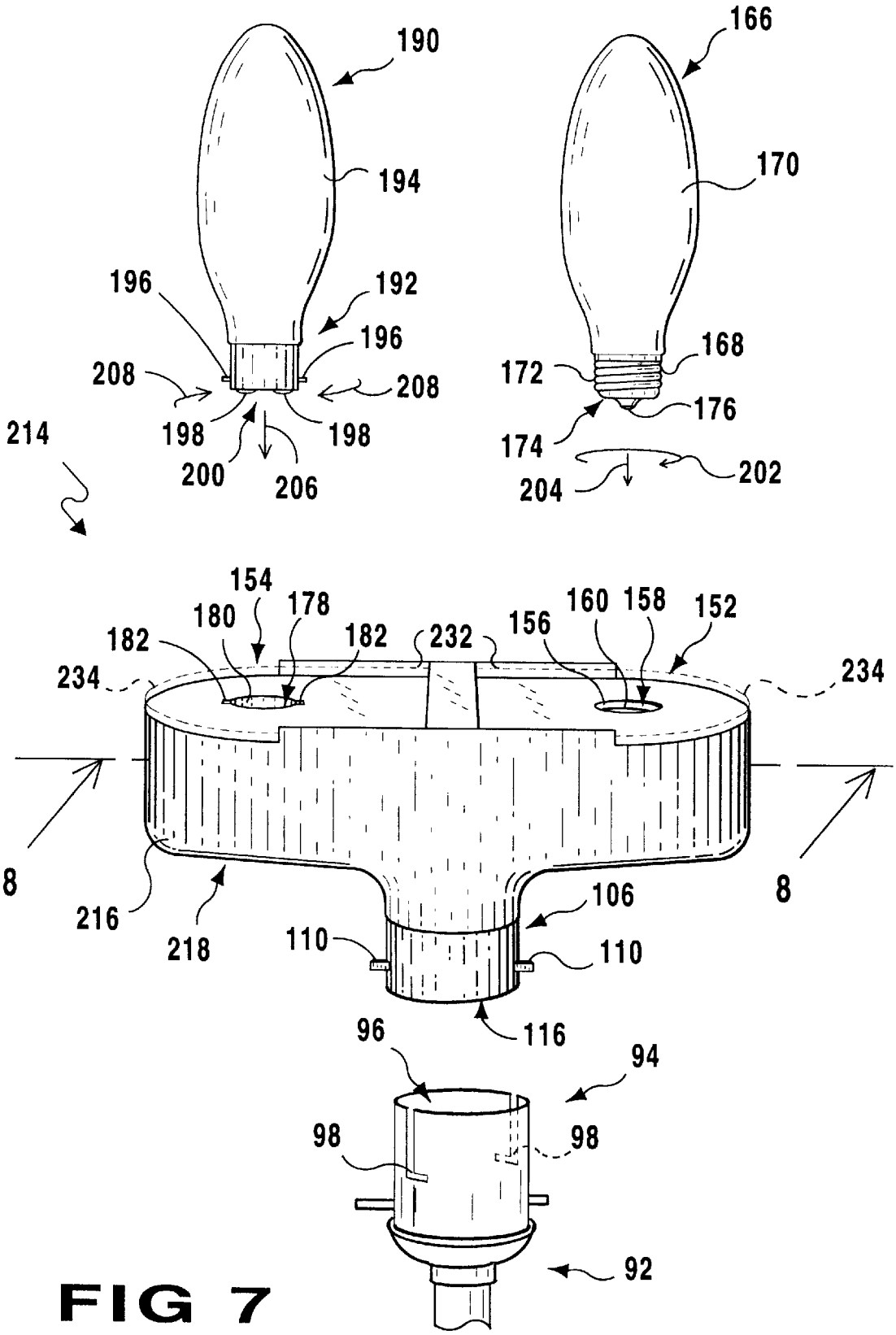
FIG. 7 is a perspective view of a fourth embodiment of the universal electrical lamp socket adapter of the present invention for connection with a standard Bayonet type electrical socket, the adapter being able to accomodate both a Edison and Bayonet candelabra type light bulbs.
Figure 8:
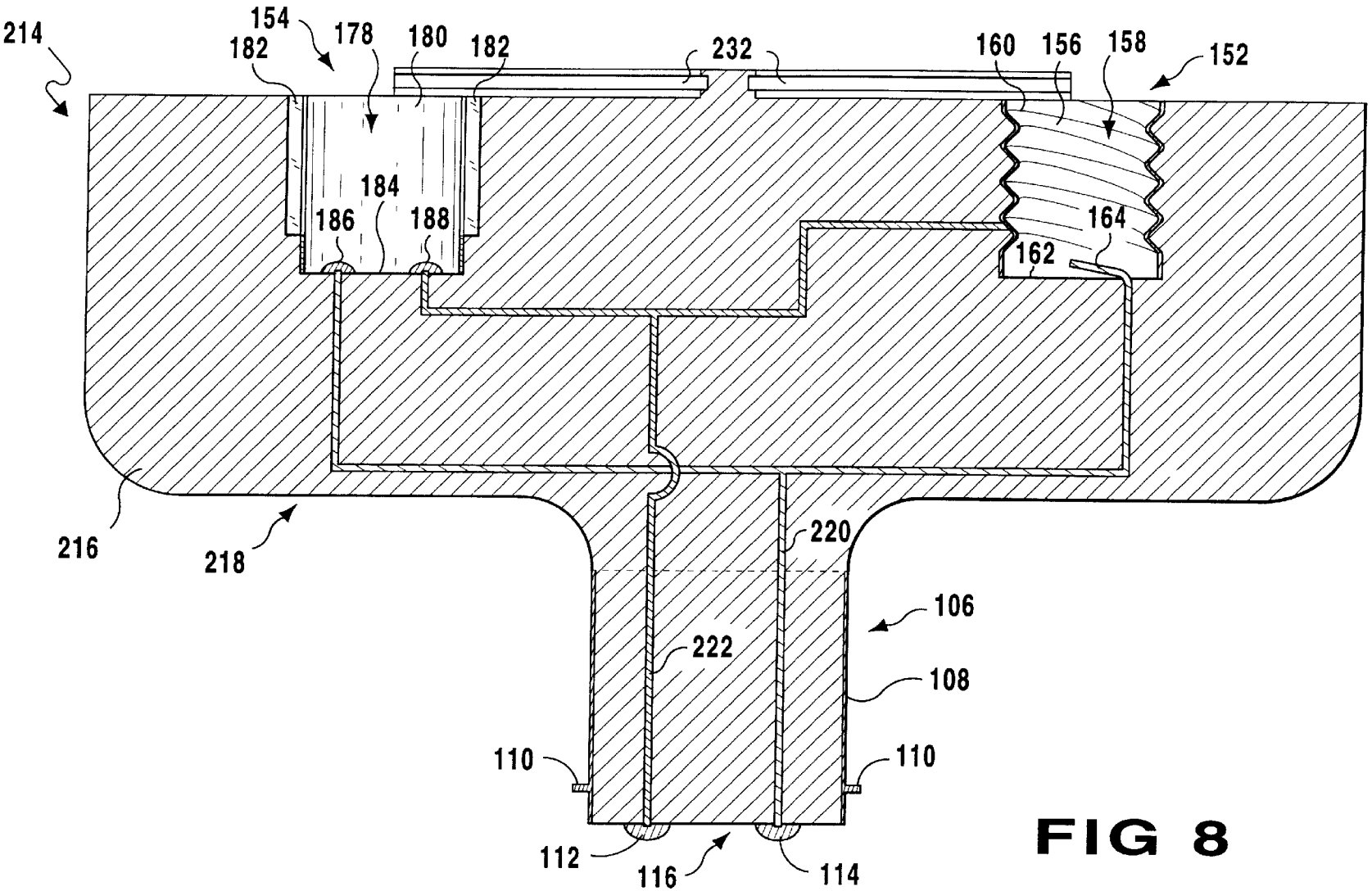
FIG. 8 is a cross-sectional view of the universal electrical lamp socket adapter of the present invention taken along the line 8—8 of FIG. 7.

A fourth embodiment of the universal electrical lamp socket adapter 214 is illustrated in FIGS. 7 and 8. This embodiment is a combination of the second and third embodiments producing a universal electrical lamp socket adapter for adapting a standard size Bayonet type socket for use with candelabra Edison and Bayonet type light bulbs. This embodiment includes a central section 216 with the Bayonet type adapter 106 of FIGS. 3 and 4 extending from an underside 216 thereof. On a top side of the central section 216 is a candelabra size Edison type socket 152 and a candelabra size Bayonet type socket 154 as illustrated in FIGS. 5 and 6. The standard size Bayonet adapter 106 and the candelabra size Edison and Bayonet type sockets 152 and 154, respectively, operate and are connected as described above with reference to the description of FIGS. 3–6.

FIG. 8 illustrates a cross-sectional view of the fourth embodiment 214. This figure illustrates a first electrically conductive coupling wire 220 connected between the first contact terminal 112 on the underside of the Bayonet type adapter 106 and the first contact terminal 186 within the bulb receiving pool 178. The first coupling wire 220 also extends through a base side 162 of the Edison type socket 152 forming the contact terminal 164 for connection to an Edison type light bulb 166 received therein. The contact terminal 164 formed within the Edison type socket 152 is electrically isolated from the electrically conductive inner wall 156. A second connection wire 222 is connected between the second contact terminal 114 on the underside of the Bayonet type adapter 106 and both the electrically conductive inner wall 156 and the second terminal 188 within the bulb receiving pool 178. The first and second coupling wires 220 and 222, respectively, provide an electrical connection with both the Edison and Bayonet type sockets 152 and 154, respectively, for providing power to light bulbs received thereby.

FIGS. 9 and 10 illustrate fifth and sixth embodiments of the universal electrical lamp socket adapter 224 and 226 respectively. The fifth embodiment 224 is identical to that of FIGS. 5 and 6 however the Edison type adapter 228 is sized to mate with a candelabra type Edison type socket. The sixth embodiment 226 is identical to that of FIGS. 7 and 8 however the Bayonet type adapter 230 is sized to mate with a candelabra type Bayonet type socket.

Each of the embodiments illustrated include a retaining device 232 for retaining a cover 234 over an unused socket. The cover 234 is illustrated in dashed lines in FIGS. 1, 3, 5, 7, 9 and 10. The cover 234 is used to prevent access to the sockets when a bulb is not received therein thereby protecting a user from contact with a live socket.

The operation of the universal electrical lamp socket adapter will now be described with reference to the figures. In operation, the base of the universal electrical lamp socket adapter is inserted into a socket of a fixture. If an Edison type socket 12 is being used, the universal electrical lamp socket adapter of FIGS. 1, 2; 5, 6; or 9 is used and if a Bayonet type socket 94 is being used the universal electrical lamp socket adapter of FIGS. 3, 4; 7, 8; or 10 is used.

When using the universal electrical lamp socket adapter of FIGS. 1, 2; 5, 6; or 9 the universal electrical lamp socket adapter is grasped by the user and positioned above the socket to which it is to be connected. The universal electrical lamp socket adapter 10 is then turned in a clockwise direction while a force is applied towards the bulb receiving pool 16 of the socket 12. The universal electrical lamp socket adapter 10 is turned until it is completely received within the bulb receiving pool 16 so that the contact terminal 30 is in contact with an electrical contact on a base of the bulb receiving pool 16.

If the power level adapters of FIGS. 3, 4; 7, 8; or 10 are used, the power level adapter is grasped by the user and positioned such that the pins 110 extending from the base 108 of the universal electrical lamp socket adapter are aligned with and received by respective ones of the L-shaped recesses 98 in the skirt of the socket 92. This allows the base 108 of the Bayonet adapter 106 to be received within the bulb receiving pool 96 of the Bayonet socket 92. The universal electrical lamp socket adapter is then turned in a counterclockwise direction causing the pins 110 extending from the base 108 to be received by the horizontal section of their respective L-shaped recess 98 in the socket 92. The first and second contact terminals on the underside of the base 112, 114 are now placed in contact with the contact terminals within the bulb receiving pool 96 of the socket 92.

The next step is to connect the Edison and bayonet type light bulbs within the respective sockets. Connecting of a standard size and candelabra size Edison type light bulb is accomplished in the same manner as is connection of a standard size and candelabra size Bayonet type light bulb.

When connecting an Edison type light bulb, the Edison type light bulb 42 must be turned in a clockwise direction as indicated by the arrow labeled 72 while applying a force towards the thread 40 spiraling within the inner side 36 of the Edison type socket 32 as indicated by the arrow labeled 74 to insert the Edison type light bulb 42 into the Edison type socket 32. This will cause the thread 48 on the base 44 of the Edison type bulb 42 to mate with the thread 40 on the inner side 36 of the Edison type socket 32 and thereby be received and held within the Edison type socket 32.

When connecting a Bayonet type light bulb to the Bayonet type socket 34 of the universal electrical lamp socket adapter 10 a force is applied to the bayonet type light bulb 60 in the direction of the arrows labeled 76. This causes the base portion 62 of the bayonet type light bulb 60 to be completely inserted into the bulb receiving pool 54 whereby the pair of pins 66 are received by their respective L-shaped recess 58. The bayonet type light bulb 60 is then turned in a counterclockwise direction as illustrated by the arrows labeled 78 causing the pair of pins 66 to be seated in a horizontal portion of their respective L-shaped recess 58 and the pair of contact terminals 68 on the underside 70 of the base portion 62 of the bayonet type light bulb 60 to form an electrical contact with a pair of contacts within the bulb receiving pool 54 to complete the circuit.

Once connected, the light bulbs are electrically connected to the source of power supplied through the socket and are operational to illuminate at the discretion of the user.

If one or both sockets are not being used the cover 234 should be connected to the cover retaining device to prevent access to the inside of the sockets and thereby prevent injury to a user accidentally contacting the live terminals within the sockets.

From the above description it can be seen that the universal electrical lamp socket adapter of the present invention is able to overcome the shortcomings of prior art devices by providing an universal electrical lamp socket adapter which allows use of an Edison type light bulb, Bayonet type light bulb or both in a single outlet and is able to form an electrically conductive connetion with an single socket, forming an electrical connection with multiple electrical sockets. The universal electrical lamp socket adapter includes a cover device providing a removable seal over any of the multiple outlets not in use to thereby protect persons in the surrounding area from possible contact with an exposed, live electrical socket and has a substantially non-conductive outer surface for protecting the user from defective sockets and inadvertant contact with electrically conductive components of the socket and/or adapter. The universal electrical lamp socket adapter is also able to provide multiple sockets receiving lower power light bulbs than that which the socket in which the adapter is placed is able to accomodate such as installation of Edison and Bayonet candelabra type light bulbs in a socket having a standard Edison type base and installation of Edison and Bayonet candelabra type light bulb into a standard Bayonet type socket. Furthermore, the universal electrical lamp socket adapter of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An universal electrical lamp socket adapter for connecting multiple light bulbs to a single electrical socket, said universal electrical lamp socket adapter comprising:

a) a central section;

b) an extension from an underside of said adapter for mating with the electrical socket;

c) first means comprising threaded socket in an upper flat surface of said central section for receiving a light bulb with a threaded base to engage said threaded socket;

d) second means comprising a bayonet shaped socket alongside said threaded socket on said upper surface of said central section for receiving a bayonet type light bulb;

e) means extending through said central section for electrically connecting said extension to both said first means and said second means for receiving wherein, when said extension is coupled to a socket power is provided to any light bulb in either or both of said first means and second means sockets.

2. The universal electrical lamp socket adapter as recited in claim 1 in which said extension is threaded to engage a threaded socket.

3. The universal electrical lamp socket adapter as recited in claim 1 in which said extension is adapted to engage a bayonet shaped socket.

* * * * *